United States Patent [19]

Marttila

[11] Patent Number: 4,599,863

[45] Date of Patent: Jul. 15, 1986

[54] COMPOUND INTERNAL COMBUSTION AND EXTERNAL COMBUSTION ENGINE

[76] Inventor: Andrew R. Marttila, 19565 Northbrook Dr., Southfield, Mich. 48076

[21] Appl. No.: 461,650

[22] Filed: Jan. 27, 1983

Related U.S. Application Data

[63] Continuation of Ser. No. 195,845, Oct. 10, 1980, abandoned.

[51] Int. Cl.[4] ..... F02G 5/02

[52] U.S. Cl. ..... 60/616; 60/617; 60/620

[58] Field of Search ..... 60/616, 617, 618, 612, 60/712, 682, 683, 653, 614, 272, 549, 512, 620; 91/273, 341 R; 123/292, 545

[56] References Cited

U.S. PATENT DOCUMENTS

| | | | |
|---|---|---|---|
| 647,651 | 4/1908 | Dow | 60/39.6 |
| 875,453 | 12/1907 | Parrett | 91/273 |
| 975,651 | 11/1910 | Sterns | 60/616 |
| 1,170,104 | 2/1916 | Rice | 60/39.6 |
| 1,188,506 | 6/1916 | Stearns | 60/616 |
| 1,400,955 | 12/1921 | Jenssen | 123/545 |
| 2,091,410 | 8/1937 | Mallory | 123/292 |
| 3,841,284 | 10/1974 | Krygowski | 123/545 |
| 4,086,771 | 5/1978 | Barrett | 60/616 |
| 4,288,406 | 9/1981 | Sims, Jr. | 60/648 |
| 4,300,513 | 11/1981 | Ray | 123/545 |

FOREIGN PATENT DOCUMENTS

| | | | |
|---|---|---|---|
| 412531 | 4/1925 | Fed. Rep. of Germany | 287/25 |
| 2204763 | 8/1973 | Fed. Rep. of Germany | 60/682 |
| 2421614 | 11/1974 | Fed. Rep. of Germany | 123/292 |
| 2633233 | 3/1977 | Fed. Rep. of Germany | 60/682 |
| 2725823 | 12/1978 | Fed. Rep. of Germany | 60/616 |
| 87849 | 12/1978 | Japan | 123/568 |

*Primary Examiner*—Michael Koczo
*Attorney, Agent, or Firm*—Hauke and Patalidis

[57] ABSTRACT

A compound engine having at least one internal combustion cylinder operating in a conventional manner, and an air or external combustion cylinder associated therewith. The external combustion cylinder operates according to the same cycle as the internal combustion cylinder, namely through consecutive intake, compression, expansion and exhaust strokes of the piston associated therewith. The charge taken by the external combustion engine is not fired and is caused to expand by transferring the heat of the exhaust gases from the internal combustion cylinder to the charge in the external combustion cylinder, at the end of the compression cycle thereof, so as to cause the gaseous fluid charge therein to expand to apply motive power to a driven output common to both the internal combustion cylinder and the external combustion cylinder.

11 Claims, 8 Drawing Figures

FIG. 3
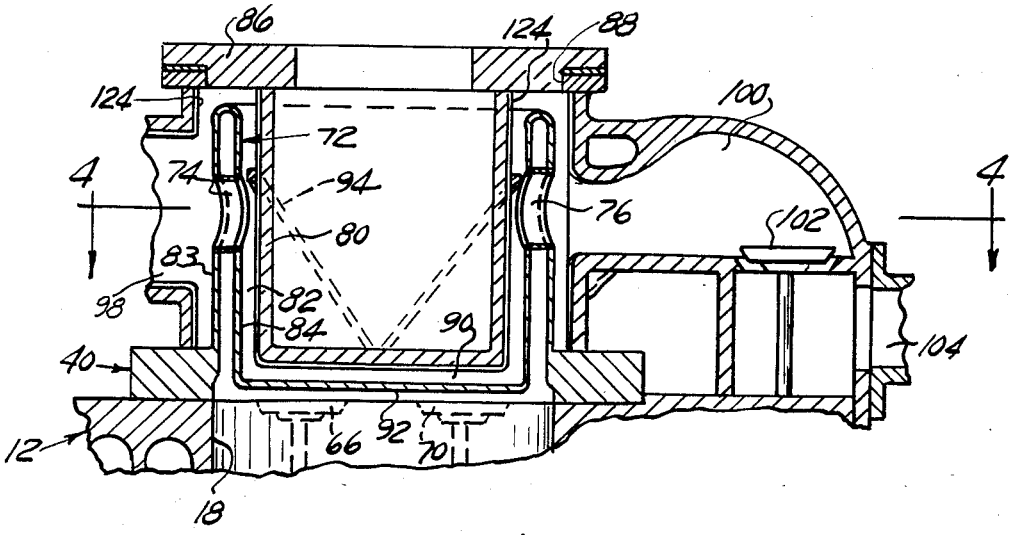
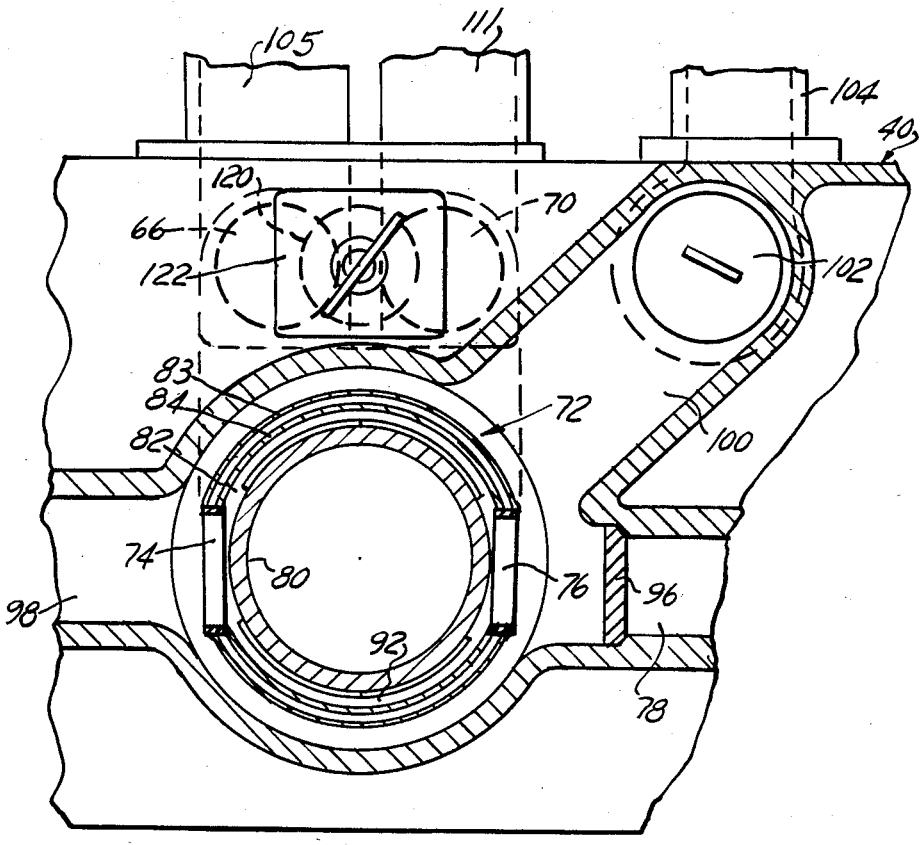
FIG. 4

COMPOUND INTERNAL COMBUSTION AND EXTERNAL COMBUSTION ENGINE

This is a continuation of application Ser. No. 195,845, filed Oct. 10, 1980, now abandoned.

BACKGROUND OF THE INVENTION

The invention relates to a compound internal combustion and external combustion engine, and more particularly to a compound engine having working cylinders operated as a conventional internal combustion engine, preferably of the diesel-cycle type, co-operating with power cylinders of the external combustion type utilizing the normally wasted heat of the exhaust gases of the internal combustion working cylinders.

It is known that the efficiency of internal combustion engines is somewhat poor, and that a great portion of the wasted energy appears in the form of heat which must be dissipated by means of sometimes complex, and always energy-wasteful, air or liquid fluid cooling systems. A great proportion of the energy wasted in the form of heat is in the exhaust gases.

Diverse systems have been proposed in the past to recuperate, at least in part, the heat energy wasted in the exhaust systems of internal combustion engines, such as, for example, utilizing the flow of hot exhaust gases for driving a compressor or supercharger compressing the ambient air introduced into the air induction system of the engine, thus increasing the over-all efficiency of the engine.

Other arrangements have been used in the past for utilizing directly or indirectly the heat lost in the exhaust of an internal combustion engine and for converting the heat to useful mechanical energy which is returned as driving power to the engine. For example, U.S. Pat. No. 951,171 contemplates an internal combustion engine driving an air compressor and utilizing the heat from the cooling system coolant and from the exhaust gases, through the coolant, to heat the air between the compressor and the inlet of a hot air cylinder to which the compressed air is supplied. U.S. Pat. No. 2,826,894 discloses vaporizing the coolant of an internal combustion engine and running an auxiliary cylinder, coupled to the internal combustion engine crankshaft, as a steam engine. U.S. Pat. No. 3,877,229 discloses operating an internal combustion engine in a fuel-rich mode, afterburning the fuel-rich exhaust gases and utilizing the heat from the exhaust gases to heat and expand air supplied to a hot air engine coupled to the crankshaft of the internal combustion engine. U.S. Pat. No. 4,086,771 contemplates utilizing a gas cooling medium, rather than a liquid, in the coolant jacket of an internal combustion engine, and supplying the heated gas to working cylinders in which the heated gas is expanded prior to returning to the cooling jacket.

SUMMARY OF THE INVENTION

The present invention provides an arrangement of elements whereby the exhaust gases from an internal combustion engine cylinder are circulated, prior to exhausting to the atmosphere, through the cylinder head heating jacket of a working external combustion cylinder into which atmospheric air has been introduced and compressed. The air in the working cylinder is heated by convection through the walls of the heating jacket, and the expansion of the heated air is converted to useful mechanical energy displacing a piston coupled to a crankshaft driven by the piston of the internal combustion cylinder. The air in the external combustion working cylinder, after expansion, is exhausted upon the return stroke of the piston into the inlet of the internal combustion cylinder.

The many objects and advantages of the present invention will become apparent to those skilled in the art when the following description of the best mode contemplated for practicing the invention is read in conjunction with the accompanying drawing wherein:

BRIEF DESCRIPTION OF THE DRAWINGS

FIG. 3 is a partial enlarged section along the line 3—3 of FIG. 1;

FIG. 4 is a section from line 4—4 of FIG. 3; and

DETAILED DESCRIPTION OF THE PREFERRED EMBODIMENT

Figure 1:
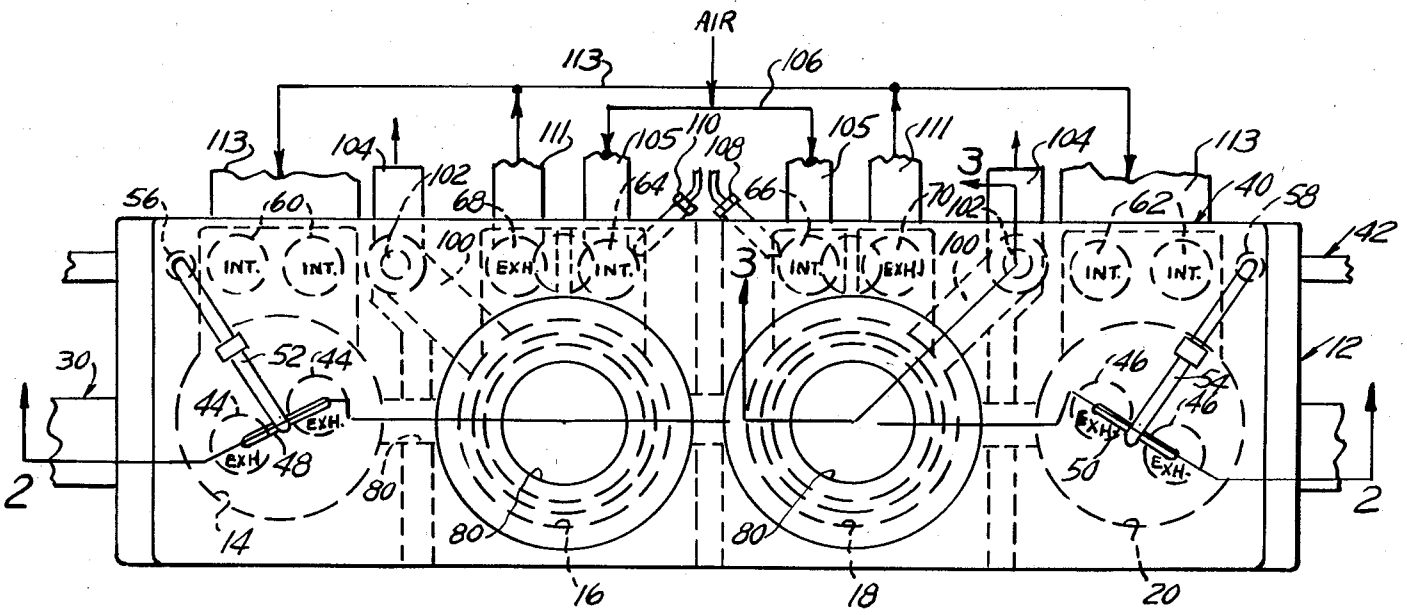
FIG. 1 is a schematic top plan view of a compound engine according to the present invention.
Figure 2:
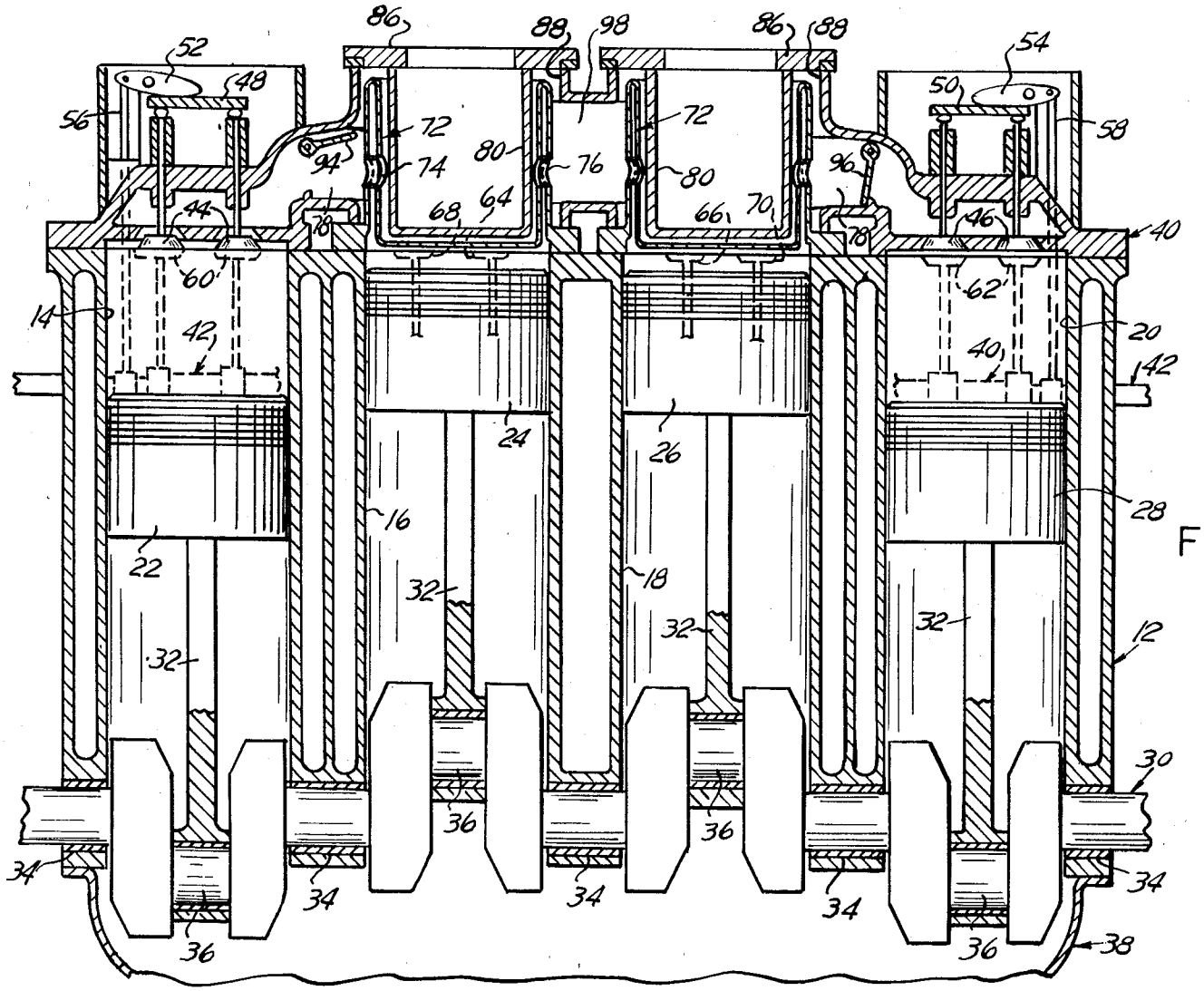
FIG. 2 is a partial section along line 2—2 of FIG. 1.

Referring to the drawing, and more particularly to FIGS. 1–2, an example of structure for a compound engine according to the present invention is illustrated as comprising a cylinder block 12 in which are provided four cylinders 14, 16, 18 and 20, in each of which is disposed a reciprocable piston, the four pistons being designated by reference numerals 22, 24, 26 and 28, respectively. The pistons 22–28 are connected to a common crankshaft 30, in the usual conventional manner by way of connecting rods 32, the crankshaft 30 being supported at the bottom of the cylinder block 12 through the usual main bearing 34, and having appropriate crank pins 36 each accepting the big end bearing of each connecting rod 32. The crank pins 36 corresponding respectively to the cylinder 14-piston 22 assembly and to the cylinder 18-piston 26 are also aligned but disposed 180° away from the two other crank pins 36. A crankcase cover 38 is fastened to the bottom of the cylinder block 12, and normally contains a provision of lubricating oil and the lubricating oil circulation pump and conduits, not shown, in a manner well known in the art.

A cylinder head block 40 is bolted on the top of the cylinder block 12 such as to close the open end of the cylinders 14–20 above the pistons 22–28. In the structure illustrated, the extreme cylinders 14 and 20 are the internal combustion working cylinders of the compound engine of the invention, while the intermediary cylinders 16 and 18 are the external combustion working cylinders. The internal combustion working cylinders 14 and 20 are working preferably according to a diesel-cycle, although it will be readily appreciated that they could be of the Otto-cycle type, or spark ignition internal combustion engine type. Each of the working cylinders 14–20, internal combustion type as well as external combustion type, are four-cycle, i.e. a complete working cycle, consisting of intake, compression, expansion and exhaust, is accomplished during a 720° rotation, or two revolutions, of the crankshaft 30. However, it will be appreciated that the principles of the invention are also applicable to two-cycle internal and external combustion compound engines, in which the working cycle is accomplished during a 360° rotation, or single revolution, of the crankshaft.

A camshaft 42 is longitudinally disposed through the cylinder block 12, substantially parallel to the longitudinal axis of the crankshaft 30, and is connected to the crankshaft by a gear or sprocket wheels and chain drive, not shown, in the usual manner such as to be driven in rotation from the crankshaft at half the speed of rotation of the crankshaft 30. The camshaft 42 is provided with a plurality of cams for operating in timed relationship appropriate inlet and exhaust valves associated with each of the cylinders 14–20.

The end cylinder 14 is provided with a pair of overhead exhaust valves 44, interconnected by a cross member 48 and operated in unison through a common rocker arm 52 by a pushrod 56. The end cylinder 20 is similarly provided with a pair of exhaust valves 46 interconnected by a cross member 50 and operated by a rocker arm 54 and pushrod 58 assembly. The internal combustion cylinders 14 and 20 are also provided each with a pair of side inlet valves 60 and 62, respectively, the valves in each pair being operated in unison from the camshaft 42.

The external combustion cylinders 16 and 18 have each a side inlet valve 64 and 66, respectively, and a side exhaust valve 68 and 70, respectively.

As best shown at FIG. 2, and in more details and at a larger scale at FIGS. 3–4 with respect to the external combustion cylinder 18, each of the external combustion cylinders 16 and 18 is placed in communication at its top with an annular heating chamber 72 into which the gaseous contents of the corresponding cylinder is displaced when the corresponding piston 24 or 26 is at its top dead center, with the inlet valves 64 and 66 and the outlet valves 68 and 70 closed, consequently at the end of the compression stroke of either the piston 24 or the piston 26. Each annular chamber 72 has a cylindrical outer wall 83 and a cylindrical inner wall 84, spaced apart, and is provided with substantially diametrically opposed radial passageways 74 and 76 to allow the exhaust gases from the internal combustion cylinders 14 and 20, admitted to an internal exhaust manifold 78 during opening of the exhaust valves 44 and 46, to flow across the heating hollow annular members 72. An inverted dome baffle 80 is disposed substantially coaxially within the cylindrical space defined by the annular heating chamber, spaced apart therefrom as to form a relatively narrow space 82 through which the exhaust gases are caused to circulate such as to be in contact with the inner wall 84 of the annular heating chamber 72. The inverted dome baffle 80 is provided with a disk or annular base 86 bolted over a corresponding opening 88 formed in the cylinder head 40. The bottom face of each inverted dome baffle 80 forms a space 90 directly above the cylinder 16 or 18, through which also circulate the exhaust gases, the inner wall 84 of the annular heating chamber 72 forming an integral parting wall 92 directly above the cylinder 16 or 18. A downwardly directed ridge 94 is peripherally disposed on the outer surface of the inverted dome baffle 80, such as to enhance flow of the hot exhaust gases passing from the passageway 74 to the passageway 76 downwardly in the bottom space 90 such as to cause direct heating of the gas remaining in the cylinder 16 or 18 above the top surface of the respective pistons 24 and 26. Therefore, when, for example, the exhaust valves 44 of the internal combustion cylinder 14 open at the end of the working cycle of the cylinder 14, the exhaust gases flowing through the exhaust manifold 78 are caused to heat the gas contained between the walls 83 and 84 of the hollow annular heating chamber 72 on the top of the external combustion cylinder 16, thus heating the gas in the annular chamber 72 and the remaining gas in the cylinder 16 above the top surface of the piston 24. The gas within the cylinder 16 above the top of the piston 24 is thus caused to expand, in turn displacing the piston 24 downwardly and supplying energy to the crankshaft 30 through the connecting rod 32. A spring return gate valve 94, disposed in the exhaust manifold 78 proximate the exhaust valve 44 of the internal combustion cylinder 14, is arranged to open during exhaust of the exhaust gases from the cylinder 14, but is caused by its return spring (not shown) to close and oppose reverse flow at all other times. Similarly, a gate valve 96 is disposed in the exhaust manifold 78 of the working internal combustion cylinder 20.

After circulating around the annular heating chamber 72 and below the inverted dome baffle 80 corresponding to the external combustion cylinder 16, the exhaust gases, which by now have been substantially cooled as a result of supplying heat to the gas in the cylinder 16, are caused to flow through a channel 98 and around and across the annular heating chamber 72 of the external combustion cylinder 18, thus supplying a small amount of heat to the walls 83 and 84 of the heating chamber 72 of the cylinder 18 and to the cylinder end wall 92. The small amount of heat thus supplied to the cylinder 18 is readily dissipated as the cylinder 18 is at this time in the course of its intake stroke, as will be explained hereinafter in more details. As the gate valve 96 is closed, the cooled exhaust gases are directed into a final exhaust passageway 100, FIGS. 3 and 4, the operation of a final exhaust valve 102 by the corresponding cam of the camshaft 42 being so timed that the exhaust valve 102 is open and let the exhaust gases escape through an exhaust manifold 104 to an appropriate muffler or pollution scrubber, not shown.

Figure 5A:
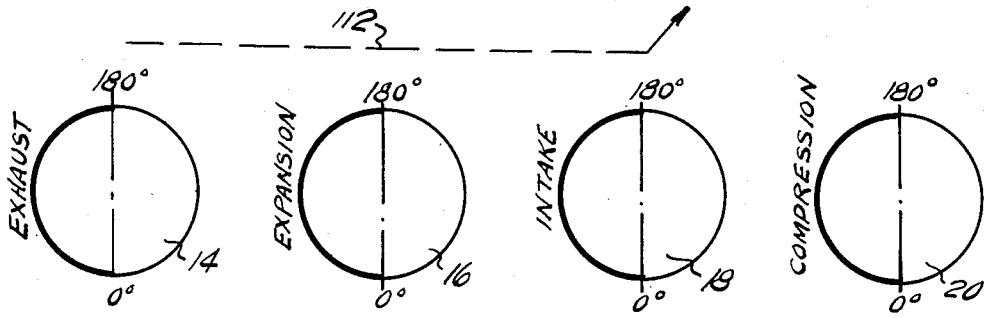
FIGS. 5*a* through 5*d* are diagrams useful in explaining the working cycle of the compound engine of the invention during a 702° rotation of the engine crankshaft.

FIG. 1 arbitrarily illustrates the respective position of the diverse pistons 22–28 that correspond to the beginning of the cycle illustrated at FIG. 5*a* as being 0° of crankshaft rotation. The exhaust valves 44 of the internal combustion cylinder 14 remain open during the exhaust stroke of the piston 22 from substantially 0° of rotation of the crankshaft to its 180° position, or for half a revolution. During the exhaust cycle of the internal combustion cylinder 14, the external combustion cylinder 16 is timed to operate during its expansion cycle, as the gas charge inside of the cylinder 16 above the top of the piston 24 is heated and thus caused to expand as a result of the hot exhaust gases from the cylinder 14 supplying heat to the annular heating chamber 72 of the external combustion cylinder 16. The external combustion cylinder 18 is timed to operate at its intake cycle, FIG. 5*a*, the inlet valve 66 thereof being open such as to let atmospheric air from the intake manifold 106, FIG. 1 flow into the cylinder 18 above the top of the piston 26, while the piston 26 is passively displaced downwardly as a result of the rotation of the crankshaft 30.

As schematically illustrated at FIG. 1, an injector 108 is arranged to inject into the atmospheric air charge taken in by the cylinder 18 atomized alcohol or water, or a mixture of both, for the double purpose of further cooling the atmospheric air introduced into the cylinder 18, and to provide additional expansion and energy as a result of turning the alcohol and/or water into vapors when heat is supplied to the charge in the external combustion cylinder 18. Similarly, the external combustion cylinder 16 is provided with an injector 110 for the same purpose, and it will be appreciated that a single injector may be provided for injecting alcohol, water, a mixture of both, or any other fluid, directly into the intake manifold 106.

At 0° of the rotation of the crankshaft, the internal combustion working cylinder 20 is at the beginning of its compression cycle, FIG. 5*a*, all of its valves, inlet valves 62 as well as outlet valve 46 being closed, the end of the compression cycle in the cylinder 20 occurring at the 180° position of the crankshaft. At FIG. 5*a*, the arrow 112 symbolically indicates that hot exhaust gases from the internal combustion engine cylinder 14 flow to the heat exchanger formed by the annular heating chamber 72 of the external combustion cylinder 16, thus causing expansion of the charge in the cylinder 16 and applying torque to the crankshaft 30, during the exhaust portion of the cycle of the cylinder 14.

As shown schematically at FIG. 1, the external combustion cylinders 16 and 18 exhaust into a common transfer manifold 113 which serves as the intake manifold for the internal combustion cylinders 14 and 20. During the subsequent 180° rotation of the crankshaft 30 from its 180° position to its 360° position, FIG. 5*b*, the internal combustion cylinder 14 is in the course of its intake cycle, during which its inlet valves 60 are open and its exhaust valves 46 are closed, the piston 22 reciprocating from its top dead center to its bottom dead center. During the intake cycle of the internal combustion cylinder 14, the external combustion cylinder 16 operates in its exhaust cycle, its piston 24 reciprocating from bottom dead center to top dead center and the exhaust valve 68 being open. The gas expelled from the external combustion cylinder 16 during the upstroke of its piston 24 is thus transferred to the cylinder 14 during the downstroke of its piston 22 through the transfer manifold 113. The arrow 114, FIG. 5*b*, symbolically represents the fluid transfer from the external combustion cylinder 16 to the internal combustion cylinder 14. Simultaneously, during the rotation of the crankshaft from its 180° position to its 360° position, the external combustion cylinder 18 is operating through its compression cycle, while the internal combustion cylinder 20 is operating through its expansion cycle, firing of the charge in the cylinder 20 having occurred substantially at the 180° position of the crankshaft, or, to be more precise, a few degrees prior thereto when fuel was injected into the compressed air above the piston 28 shortly prior to the piston 28 reaching its top dead center. At the 360° position of the crankshaft, the charge in the internal cylinder combustion 20 is fully expanded, thus having applied energy to the piston 28 during its downstroke displacement from its top dead center to its bottom dead center and driving the crankshaft 30 through the corresponding connecting rod 32. Approximately when the crankshaft occupies its 360° position, FIG. 5*c*, the exhaust valves 46 of the internal combustion cylinder 20 open and, during the subsequent rotation of the crankshaft from its 360° position to its 540° position, upstroke of the piston 28 pushes the hot exhaust gases through the internal exhaust manifold 78 associated with the cylinder 20, the gate valve 96 being caused to open by the flow of exhaust gases while the gate valve 94 is caused to close. The exhaust gases release the majority of their heat to the pre-compressed air in the external combustion cylinder 18, thus causing expansion of the air, and of the alcohol or water vapors mixed therewith, thus forcibly displacing the piston 26 from its top dead center to its bottom dead center and applying motive power to the crankshaft. During that portion of the cycle, the external combustion cylinder 16 is taking a fresh charge through its open intake valve 64 and the internal combustion cylinder 14 is operating during its compression stroke or cycle. The arrow 116, FIG. 5*c*, arbitrarily indicates the flow of exhaust gases from the internal combustion cylinder 20.

Figure 5B:
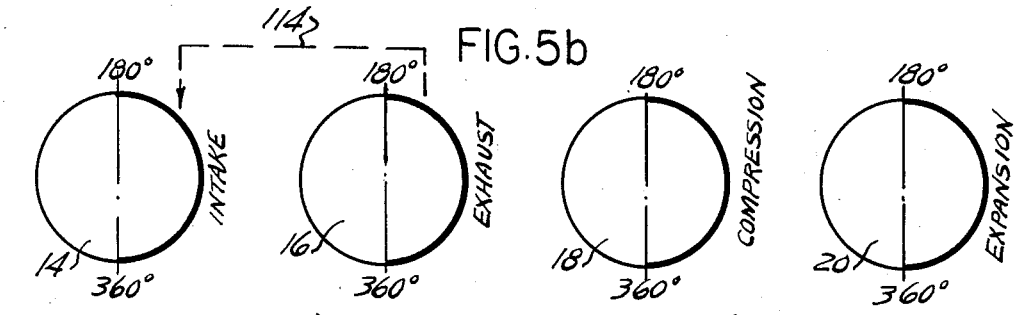
Figure 5C:
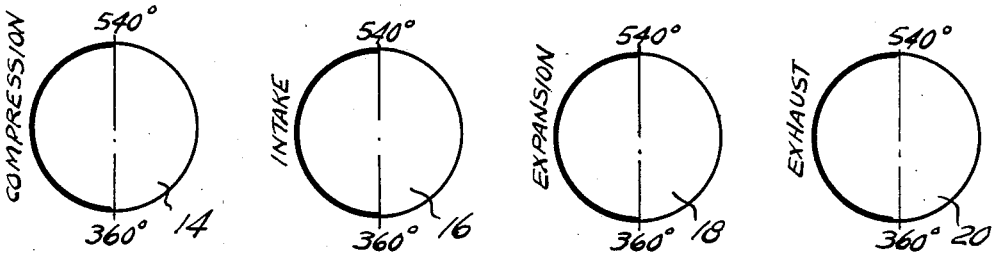
Figure 5D:
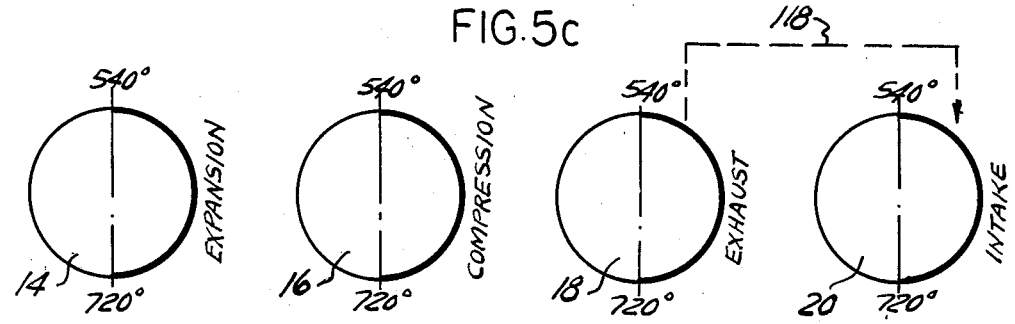

When the crankshaft occupies its 540° position, FIG. 5*d*, or more exactly a few degrees prior to the crankshaft occupying that position, fuel is introduced into the combustion chamber of the internal combustion cylinder 14, while the piston 22 is at, or proximate to, its top dead center, after the charge of atmospheric air in the compression chamber above the top of the piston has been compressed to its smallest volume. During rotation of the crankshaft from its 540° position to its 720° position, FIG. 5*b*, the ignited fuel-air mixture is expanding, and energy is transferred from the piston 22, during its downward stroke from top dead center to bottom dead center, through the connecting rod 32 and the crank pin 36 to the crankshaft 30. Simultaneously, the external combustion cylinder 16 is operating through its compression cycle, while the external combustion cylinder 18 is exhausting into the combustion chamber of the internal combustion cylinder 20 operating through its intake cycle. The arrow 118 arbitrarily represents such transfer of the charge from the external combustion cylinder 18 to the internal combustion cylinder 20. The four operating cycles of each cylinder are subsequently repeated through the next 720° rotation of the crankshaft.

The crankshaft 30 is therefore subjected to four working cycles for each 720° rotation, or two revolutions, each working cycle extending substantially over each 180° rotation of the crankshaft during a complete cycle.

It will be appreciated that the internal combustion cylinders 14 and 20 may operate as conventional or Otto-cycle spark ignition internal combustion cylinders, an appropriate fuel, such as gasoline for example, being introduced by conventional carburetor means into the charge transferred from an external combustion cylinder to a corresponding internal combustion cylinder during the simultaneous exhaust cycle of the external combustion engine cylinder and intake cycle of the corresponding internal combustion cylinder, FIGS. 5*b* and 5*d*.

Starting of the compound engine of the invention is facilitated by a decompression valve 120, FIG. 4, mounted on a cover plate 122 over the external combustion cylinder intake and exhaust valves such as to enable direct atmospheric air intake into the diesel-cycle internal combustion cylinders 14 or 20, if so desired, to enable cold start of the engine. During normal functioning of the engine, the presence of vapors of alcohol or water, or both, in the air charge taken by the internal combustion cylinders greatly improves the combustion characteristics of the air-fuel mixture and the flame propagation characteristics, and greatly reduces preignition and detonation. It is desirable to have the exhaust gases from the internal combustion cylinders to be as high a temperature as feasible, taking into consideration the metallurgical characteristics of the material used for making the exhaust valves and exhaust valve seats and the exhaust passageways and manifolds. Preferably, the surface of the inverted dome baffle 80 in contact with the exhaust gases is coated with a thin layer of ceramic material, as shown at 124 at FIG. 3. The walls of the exhaust manifold 98 may also be protected with a thin layer of ceramic material which, in addition to being substantially thermo-shock proof, acts as a heat insulation reducing substantially transfer of the heat to the subjacent metal, cast iron or steel, used for making the manifold and the dome-shaped baffle 80.

Considerable heat energy is present in the exhaust gases whose temperature is generally in the range of 350° C. to 900° C., or even more when such exhaust gases are obtained from a leaned-out internal combustion cylinder. Cooling exhaust gases from such a high temperature to 200°-250° C. through transfer of their heat to the gas contained on the top of the pistons 24 and 26 in the external combustion cylinders 16 and 18, before allowing the exhaust gases to escape to the atmosphere and transforming that heat energy into motive power energy, result in an appreciable increase of the over-all efficiency of any internal combustion engine.

Having thus described the present invention by way of an example of structure incorporating the principles of the invention, modifications whereof will be apparent to those skilled in the art, what is claimed as new is as follows:

1. A compound engine comprising at least one internal combustion cylinder having an inlet and an outlet and one external combustion cylinder having an inlet and an outlet, each of said cylinders having a reciprocable piston therein coupled to a common utilization output shaft, heat exchanger means associated with said external combustion cylinder for transferring heat to a space in said cylinder above said piston in said external combustion cylinder, means for transferring hot exhaust gases exhausted from said internal combustion cylinder during its exhaust cycle to said heat exchanger means, means for introducing a heat expandable gas through the inlet of said external combustion cylinder into said space above said piston in said external combustion cylinder whereby heat transferred by said heat exchanger means to said space during passage of said exhaust gases through said heat exchanger means causes cooling of said exhaust gases and expansion of said heat expandable gas in said space imparting motive power to said piston in said external combustion cylinder and to said common utilization output shaft in addition to motive power applied to said shaft by said piston in said internal combustion cylinder during conventional expansion cycles in said internal combustion cylinder, means for exhausting said heat expandable gas after expansion in said combustion cylinder to the inlet of said internal combustion cylinder, and means for exhausting said cooled exhaust gases to the ambient, wherein said expandable gas after expansion is exhausted to said inlet of said internal combustion engine cylinder during a return stroke of the piston associated with said external combustion cylinder effectuated simultaneously with a downstroke of the piston associated with said internal combustion cylinder, and wherein said heat exchanger means comprises an annular chamber disposed above and in communication with said external combustion cylinder, whereby a portion of said expandable gas is displaced into said annular chamber during upstroke of the piston associated with said external combustion cylinder in the course of a compression cycle in said external combustion cylinder.

2. The compound engine of claim 1 wherein said expandable gas is atmospheric air introduced into said external combustion cylinder and compressed in said cylinder by reciprocation of said piston associated with said cylinder during its compression stroke.

3. The compound engine of claim 2 further comprising means for injecting a fluid in said atmospheric air.

4. The compound engine of claim 3 wherein said fluid is alcohol.

5. The compound engine of claim 3 wherein said fluid is water.

6. the compound engine fo claim 3 wherein said fluid is a mixture of alcohol and water.

7. The compound engine of claim 1 further comprising a baffle in the form of an inverted dome disposed concentrically to said annular chamber and arranged to form a space between the surface of said baffle and an external wall surface of said annular chamber, and passageway affording passage of said exhaust gases across said annular chamber for circulation of said exhaust gases into said space.

8. The compound engine of claim 7 wherein said dome-shaped baffle has an outer surface coated with a layer of ceramic material.

9. The compound engine of claim 1 wherein said internal combustion cylinder and said external combustion cylinder operate according to consecutive cycles of intake, compression, expansion and exhaust effected during two complete revolutions of said utilization output shaft.

10. The compound engine of claim 1 wherein said internal combustion cylinder operates according to a diesel engine cycle.

11. The compound engine of claim 2 wherein said internal combustion cylinder operates according to a diesel engine cycle.

* * * * *

UNITED STATES PATENT AND TRADEMARK OFFICE

CERTIFICATE OF CORRECTION

PATENT NO. : 4,599,863

DATED : July 15, 1986

INVENTOR(S) : ANDREW R. MARTTILA

It is certified that error appears in the above-identified patent and that said Letters Patent is hereby corrected as shown below:

Column 2, line 21, change "702°" to --720°--.

Column 5, line 52, change "cylinder combustion" to --combustion cylinder--.

Claim 6, line 1, change "fo" to --of--.

Signed and Sealed this

Fourteenth Day of October, 1986

[SEAL]

*Attest:*

DONALD J. QUIGG

*Attesting Officer*

*Commissioner of Patents and Trademarks*